United States Patent [19]

Honda et al.

[11] 4,109,709

[45] Aug. 29, 1978

[54] HEAT PIPES, PROCESS AND APPARATUS FOR MANUFACTURING SAME

[75] Inventors: Ichiro Honda; Shigetoshi Takasu, both of Tokyo; Yoshio Onuki, Yachiyo, all of Japan

[73] Assignee: Suzuki Metal Industrial Co, Ltd., Tokyo, Japan

[21] Appl. No.: 686,983

[22] Filed: May 17, 1976

Related U.S. Application Data

[62] Division of Ser. No. 468,033, May 8, 1974, Pat. No. 4,018,269.

[30] Foreign Application Priority Data

| | | | |
|---|---|---|---|
| Sep. 12, 1973 | [JP] | Japan | 48-103494 |
| Nov. 8, 1973 | [JP] | Japan | 48-129393[U] |
| Nov. 8, 1973 | [JP] | Japan | 48-129394[U] |

[51] Int. Cl.[2] ..... F28D 15/00

[52] U.S. Cl. ..... 165/105; 138/40; 29/157.3 R

[58] Field of Search ..... 165/105; 138/40; 29/157.3 R

[56] References Cited

U.S. PATENT DOCUMENTS

| | | | |
|---|---|---|---|
| 3,498,369 | 3/1970 | Levedahl | 165/105 |
| 3,576,210 | 4/1971 | Trent | 165/105 |
| 3,681,843 | 8/1972 | Arcella et al. | 165/105 X |
| 3,779,310 | 12/1973 | Russell | 165/105 |
| 3,786,861 | 1/1974 | Eggers | 165/105 |
| 3,789,920 | 2/1974 | Low | 165/105 |

FOREIGN PATENT DOCUMENTS

| | | | |
|---|---|---|---|
| 276,093 | 3/1969 | U.S.S.R. | 165/105 |

*Primary Examiner*—Albert W. Davis, Jr.
*Attorney, Agent, or Firm*—Frank J. Jordan

[57] ABSTRACT

Heat pipes comprising an outer tubular material closed at both ends, a wick of metal fibers, an inner tubular material covered with the wick and inserted in the outer tubular material and a heat transfer volatile liquid confined in the closed outer tubular material. An evaporation region and a condensing region are respectively constituted in the end portions of the outer tubular material. The liquid in the evaporation region vaporizes when heated and the vapor is passed to the condensing region to condense while giving the heat of the vapor to other materials outside the heat pipe, and the condensed liquid is returned to the evaporation region by the capillary action of said wick, thus repeating a cycle of the evaporation and condensation.

6 Claims, 28 Drawing Figures

FIG. 1A
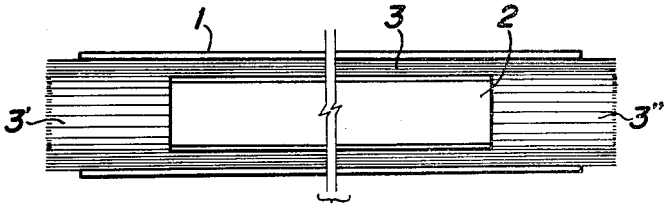
FIG. 1B
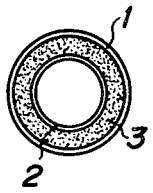
FIG. 2
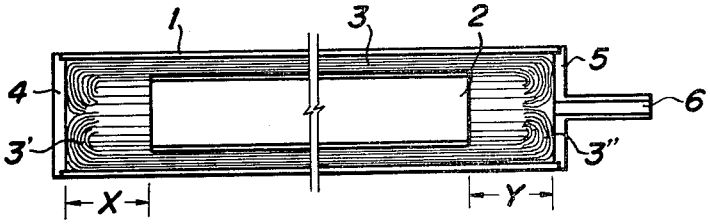
FIG. 3
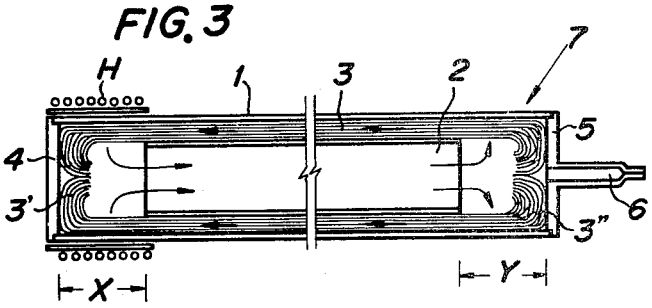
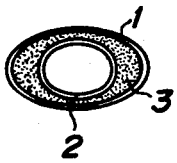
FIG. 4a
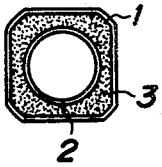
FIG. 4b
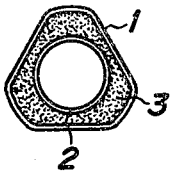
FIG. 4c
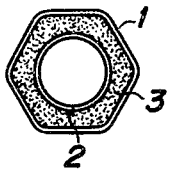
FIG. 4d 6-1

6-2

HEAT PIPES, PROCESS AND APPARATUS FOR MANUFACTURING SAME

This is a division, of application Ser. No. 468,033, filed May 8, 1974, now U.S. Pat. No. 4,078,269.

This invention relates to heat transfer devices known as heat pipes, and to a process and apparatus for the manufacuture thereof and wicks therefor.

Generally, a heat pipe comprises a tubular container having evaporation and condensing regions respectively and having both ends sealed, in which container are enclosed a heat transfer liquid and a wick, that is a capillary means, disposed to cover all of the inner wall of the container except for a portion of the condensing region. In the heat pipe, the liquid is heated at the evaporation region to form vapor thereof which flows axially through the central portion of the pipe to the condensing region, condenses to the original liquid and is then returned to the evaporation region through the wick by its capillary action. Thus, heat is transported from the evaporation region to the condensing region by the vapor having the heat as its latent heat. As conventional wicks for heat pipes there have heretofore been used a wire mesh, metal and glass fiber webs pressure secured to the inner wall of the pipe, as well as the fine grooves formed in the inner wall of the pipe in the direction of the axis thereof and fine metallic particles coated and sintered on the inner wall of the pipe. It has, however, been found that these conventional wicks exhibit a great resistance to the flow of the liquid therethrough, and that when they are made in thicker layers to decrease such resistance they will cause the heat transferability at the evaporation and condensing regions and the amount of heat transferred to be decreased. A wick in the form including fine grooves has satisfactorily less flow resistance and high heat transferability at the evaporation and condensing regions but has unsatisfactory capillary action and difficulty in the formation thereof by machining. A wick comprising metallic particles has the same drawbacks as the wire mesh. Further, heat pipes containing conventional wicks have the common disadvantage in that the wick once manufactured, cannot be changed in general shape, bulk density and the like if such is attempted to be done for a particular purpose, and that they cannot be bent and deformed without damage to their structure and function.

The heat pipe of this invention comprises a closed outer metal tube, an open inner metal tube being shorter in length than the outer tube and being disposed in the outer tube coaxially therewith to define an annular aperture therebetween, a wick made of bundles of metal fibers extending parallel to the axis of the inner tube beyond the ends thereof and filling the said annular aperture therewith, and a heat transfer volatile liquid confined in the pipe. A tubular material for the outer tube may be a known solid drawn metal tube or a known seamed metal tube prepared by laterally folding or curling a metal hoop and welding the shutting edges thereof by a tube-forming machine to form a seamed tube, and a tubular material for the inner tube may be a known solid drawn metal tube or a spirally formed metal hoop (not welded at the adjacent edges thereof). The tube-forming machine comprises a tube-forming means and a welding means.

In one aspect of this invention, a heat pipe is obtained by inserting the metallic fibers in tow form into the annular aperture between the outer and inner tubes to form a wick, fitting an end plate to each end of the outer tube, one of the end plates being provided with a nozzle for charging therethrough a heat transfer liquid into the outer tube, charging the liquid inside the outer tube and then closing the nozzle to obtain the heat pipe which is, if desired, compressed so as to make the metal fibers more compact and/or form the heat pipe is a desired cross-sectional shape. If desired, the metal fibers may be heated to form thereon a film of oxide thereof in an oxidizing atmosphere before their insertion into the annular aperture, or after said insertion but before the sealing of both the ends of the outer tube as well as the compression thereof.

In another aspect of the invention, a heat pipe is obtained by laying rows or yarns of metal fibers on a tubular material forming an inner tube of the heat pipe, such as a thin-walled metal tube, a close-spiralled metal hoop, or an alternately close- and rough-spiralled metal hoop to form a layer or wick of the metal fibers thereon, spirally winding a binding material such as yarns of metal fibers, yarns of chemical or natural fibers, or metal wire around said layer or wick to secure it to the inner tube, heating the wick-secured inner tube to oxidize the surface of the wick thereby obtaining the oxidized wick-secured if desired, inserting the wick-secured or oxidized wick-secured inner tube into a tubular material which will form the outer tube of the heat pipe, such as a metal tube or covering the wick- or oxidized wick-secured inner tube with a metal hoop being laterally wound or curled around the inner tube while welding the seams or edges of the wound pipe-like hoop (thus forming an outer tube) by a tube-forming machine to form a heat pipe blank, cutting the blank into pieces of a desired length, charging a heat transfer liquid in piece, closing both the ends of the piece to obtain the heat pipe which is, if desired, then radially compressed or cold worked to suitably compact the wick of metal fibers and or form the heat pipe to a desired cross-sectional shape by the use of a drawing die, rolls and swages.

It has heretofore been difficult to manufacture heat pipes having a small diameter and large length by conventional known processes since the diameter and length of conventional heat pipes to be manufactured are limited mainly due to the nature of wicks used and the method of the fixing the wick inside the pipe.

This invention, on the other hand, has made it possible to easily manufacture even heat pipes which have an inner diameter of as small as 2 mm or less and those which are as long as starting materials (such as tubes, hoops for the inner tube, wicks of metal fibers and hoops for the outer tube) permit. The long heat pipes so obtained may be reduced in outer diameter to a considerable extent and may, as required, be cut into pieces of a suitable length which are then closed at both ends. This invention has thus made it possible to obtain highly efficient heat pipes, even if their diameter is extremely small, at a low cost in a discontinuous or continuous fashion.

Now, the starting materials for the heat pipes of this invention will be illustrated as follows:

(1) Materials for the inner tube include a metal tube and a metal hoop capable of being spirally formed. The term "metal tube" used herein means a solid drawn metal tube.

(2) Materials for the wick include tows or yarns of metal fibers of 0.004 to 0.03 mm in diameter.

(3) Materials for securing the wick to the inner tube include yarns of metal fibers having a diameter of 0.004 to 0.03 mm, yarns of general fibers, and metal wire.

(4) Materials for the outer tube include a metal tube and a metal hoop capable of being laterally curled or wound while welding the edges of the wound hoop by the use of a tube-forming machine.

It is therefore an object of this invention to avoid the aforesaid drawbacks of the conventional heat pipes and provide a heat pipe which has a great capillary action, low flow resistance, satisfactory heat transferability and flexibility thereby allowing the pipe to be bent for a specified use.

Another object of this invention is to provide a wick for a heat pipe, which is excellent in capillary action and flexibility with low flow resistance.

Still another object of this invention is to provide a new process and apparatus for the manufacture of the wick and heat pipe.

The above-mentioned and other features and objects of this invention will become more apparent by reference to the following description taken in conjunction with the accompanying drawings in which:

FIGS. 1*a* and 1*b* respectively show longitudinally and cross-sectional views of a heat pipe blank comprising an outer metallic pipe, an inner metallic pipe and a metallic fiber wick inserted therebetween according to this invention;

FIG. 2 is a view of the heat pipe blank of FIG. 1 the ends of which are sealed by end plates one of which is provided with a nozzle for charging a heat transfer liquid;

FIG. 3 is a view of another embodiment of a heat pipe of this invention in operation;

Figure 5:
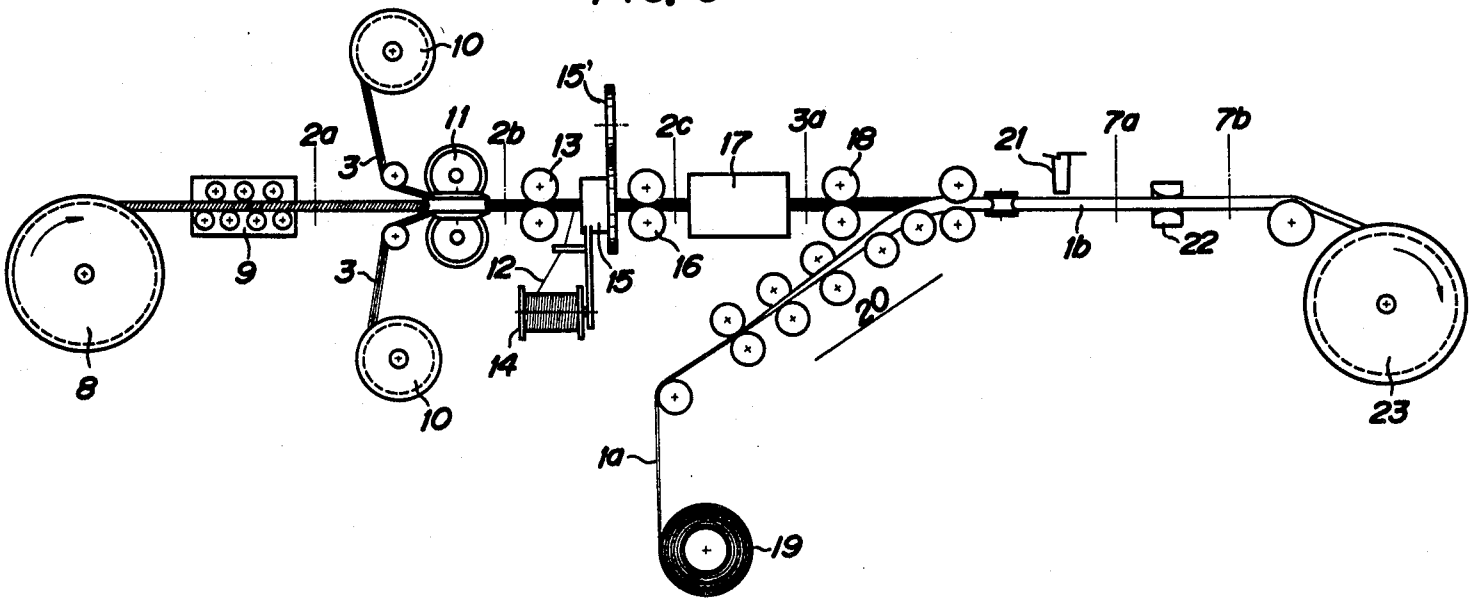
Figure 14:
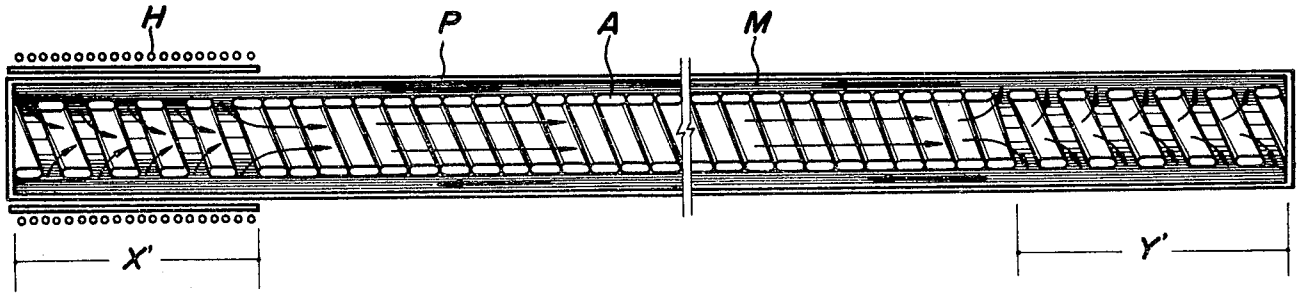
Figure 9:
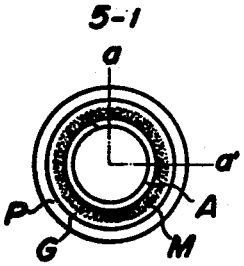
Figure 9A:
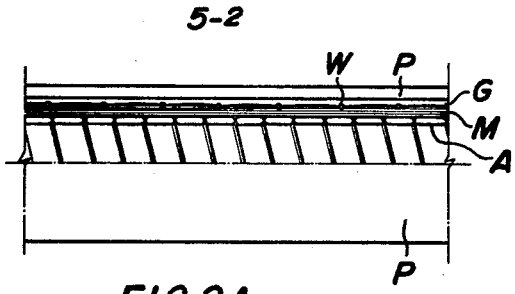
Figure 10:
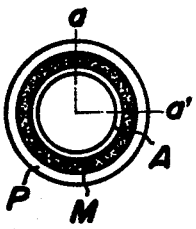
Figure 10A:
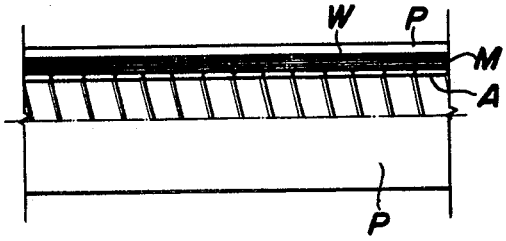
Figure 11:
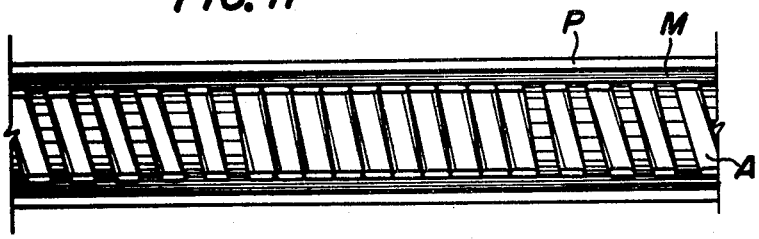
Figure 12:
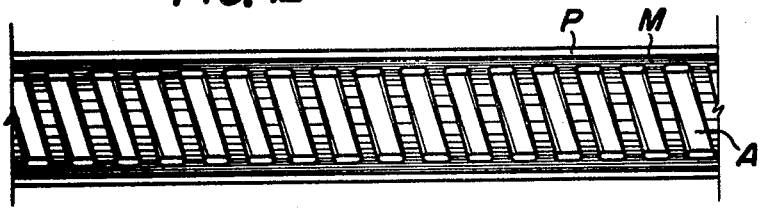
Figure 13:
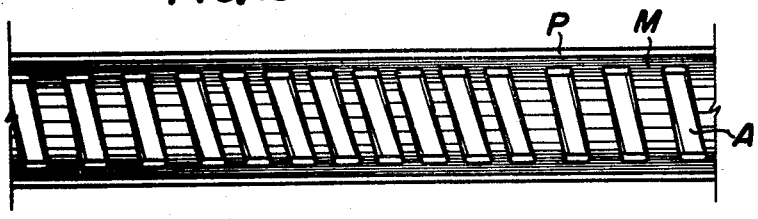
Figure 15:
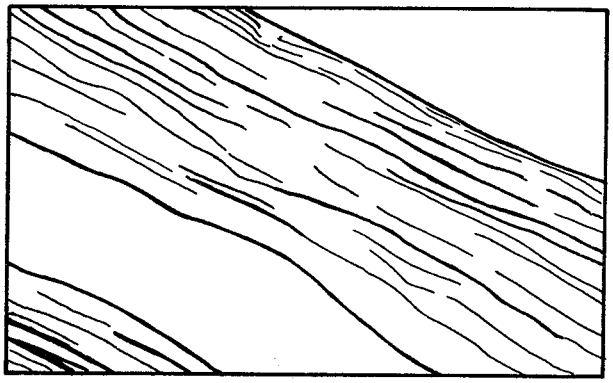
Figure 16:
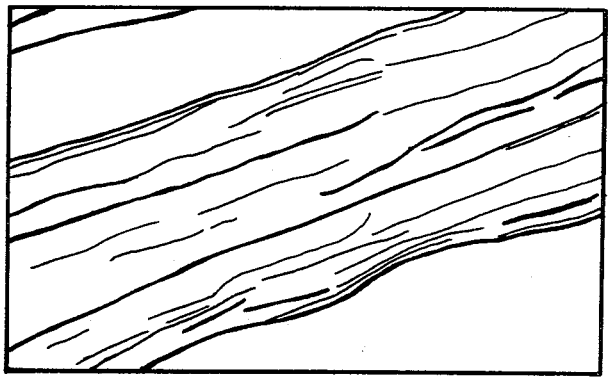
Figure 17:
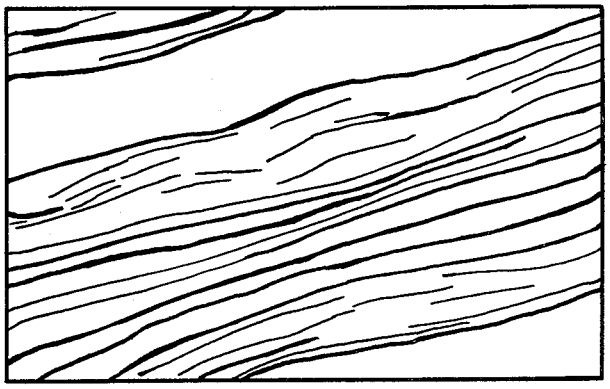
Figure 18:
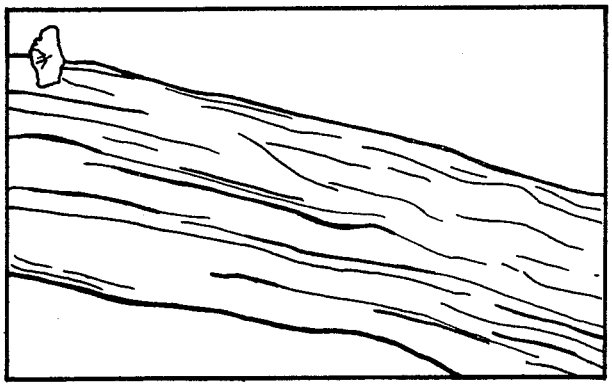
Figure 19:
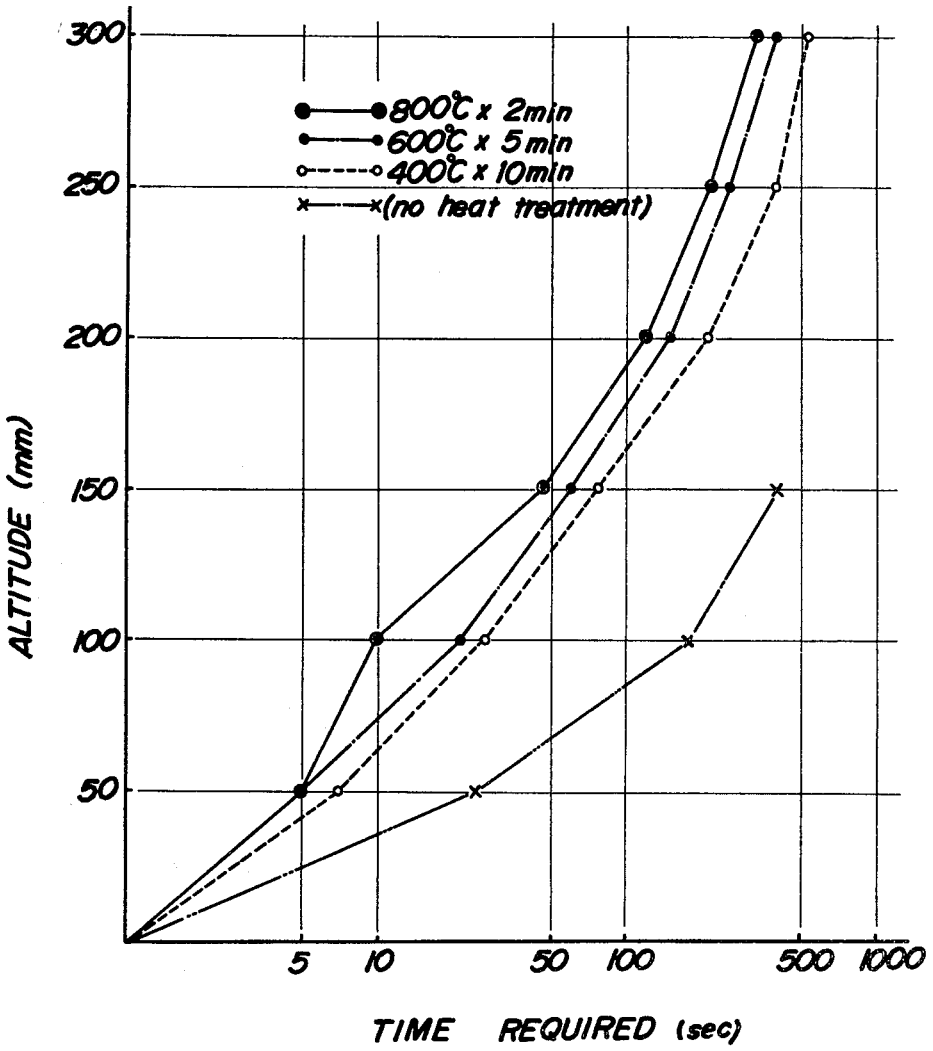

FIGS. 4*a*, 4*b*, 4*c* and 4*d* respectively show various cross-sectional views of heat pipes the outer tube of which is compressed;

FIG. 5 is a diagrammatic illustration of an apparatus embodying this invention;

FIGS. 6 –10 and 6A –10A illustrate cross-sectional views and longitudinally sectional view respectively taken along the lines *a*–*a'* of the cross-sectional views, of a blank for a heat pipe of this invention at each of the points A, B, C, D and E in the course of manufacture from starting materials to the heat pipe; and FIGS. 11 – 13 are each a longitudinally sectional view of a heat pipe containing a particular spirally formed hoop as the inner tube according to this invention;

FIG. 14 is a view showing the function of an alternately close- and rough-spiralled hoop as the inner tube of a heat pipe embodying this invention;

FIGS. 15 – 18 are each a photograph showing the surface condition of oxidized metallic fibers, in magnified form, according to this invention; and FIG. 19 is a graph showing the relationship between altitudes the heat transfer liquid reached and times the liquid required to reach the altitudes.

This invention will further be explained by reference to the following description taken in conjunction with the accompanying drawings.

Referring now to FIGS. 1 – 4, an embodiment of this invention is detailed below.

Numeral 1 designates an outer metal tube, numeral 2 an inner metal tube which is shorter in length and smaller in diameter than the outer tube 1 and numeral 3 metal fibers in tow form which fill up the aperture between the inner and outer tubes therewith as indicated in FIG. 1*b*. The outer tube is closed at both ends with end plates 4 and 5, the plate 5 being provided with a nozzle 6 for charging a volatile heat transfer liquid therethrough into the outer metal tube as shown in FIG. 2. The liquid is fed into the outer tube through the nozzle 6, after which the end plate 5 perfectly closes the end of the outer tube by closing the nozzle 6 as indicated in FIG. 3. The presence of a difference in length between the outer and inner tubes results in the formation of an evaporation region X and a condensing region Y.

In a double tube structure comprising the outer metal tube 1 and the inner metal tube 2 which is shorter in length and smaller in diameter than the outer tube 1 and in which the tube 2 is placed in the tube 1 coaxially therewith, the tows of metal fibers having a diameter of not larger than 40 $\mu$ and being a little longer than the outer tube 1 are disposed in parallel to each other with their ends 3' and 3'' protruding beyond the ends of the outer tube 1, respectively, in the aperture defined by the inner wall of the inner tube 2 as shown in FIG. 1; the protruded portions 3' and 3'' of the metal fibers are curled back when the outer tube 1 is closed at both ends, thereby to fix the inner tube 2 and constitute the inner tube-free working regions X and Y. The amount of the metal fibers present in each of the regions X and Y may be varied depending on the condition of use of the resulting heat pipe containing said regions. In this manner, according to this invention, the metal fibers 3 are used as the wick and the wick is prevented from peeling from the outer and inner tubes even if the resulting heat pipe is bent since the wick is held between said tubes constituting a double tube structure. The metal fibers 3 have a great capillary action as their inherent property and also have a low flow resistance since they are disposed on the inner tube 2 in parallel to the flow direction of the working liquid. The inner tube 2 does not extend to each end portion of the outer tube (that is, a free space is present in each end portion of the outer tube) and the metal fibers as the wick have a large total surface area, thereby allowing the resulting heat pipe to have a satisfactory heat transferability with the result that the amount of heat transferred per unit time is increased. The heat transfer liquid (or working liquid) is then injected into the outer tube through the nozzle 6, after which the nozzle 6 is closed thereby to obtain a heat pipe 7. As shown in FIG. 3, in the thus-obtained heat pipe 7, the evaporation region X when heated as by a heater H evaporates the working liquid held in the metal fiber wick 3' to produce vapor of the liquid which passes through the inside of the inner tube 2 to the condensing region Y where the vapor is cooled and condensed thereby to transfer the heat obtained from the vapor to a body with which the outer tube end portion containing the condensing region is in contact.

According to this invention, the metal fibers may, if desired, be heated to 350°–900° C in an oxidizing atmosphere before the sealing of the outer tube at both ends, to form a film of their oxide thereon thereby improving the fibers wettability properties with the working liquid. The metal fiber wick 3 held between the outer and inner tube of the heat pipe as produced is not always in a suitably compacted state. If desired, therefore, the heat pipe may be cold worked by the use of a drawing die, rolls, swager or the like, to obtain a desired compactness (or filling ratio) on the wick, improves the wick in capiliary action and produce a heat pipe having a desired cross-sectional shape as is shown from FIG. 4.

By drawing, the outer tube is reduced in inner diameter as well as in outer diameter, while the inner tube remains approximately the same as the original, whereby the aperture between the outer and inner tubes is lessened and the wick 3 present in the aperture is accordingly compacted to attain a desired bulk density, that is filling ratio, of the wick.

Another embodiment of this invention is detailed below.

Referring now to FIG. 5, a long tube or long spirally formed hoop 2*a* forming the inner tube 2 of a heat pipe 7 is supplied from a spool 8 and passed through a straightening means 9 where the long tube or spiralled hoop 2*a* is straightened. While being passed towards a take-up reel 23, the straightened tubular body 2*a* is covered with metal fibers 3 in the tow or yarn form supplied from a plurality of reels 10 arranged radially with respect to the direction in which the tubular body 2*a* is advanced. The numeral 11 designates pressing rolls to form the metal fibers 3 laid on the tubular body 3 to a uniform layer thereof around the body 3, and the numeral 2*b* indicates the uniformly metal fiber-covered tubular body. The metal fiber-covered tubular body 2*b* is wound spirally with a fibrous material 12 such as a yarn of metal or other fibers as well as metal wire thereby obtaining the metal fiber-fixed tubular body 2*c*, the fibrous material 12 being supplied from a spool 14 rotated around the passing tubular body 2*b* by a rotary winding means 15. The numeral 16 designates guide rolls. The metal fiber-fixed tubular body 2*c* is further passed through, for example, a heating furnace 17 where the body 2*c* is treated so that the wick 3 fixed thereon is oxidized on the surface, through guide rolls 18, through a tube-forming means 20 where the oxidized wick-fixed tubular body 2*c* is covered with a metal hoop 1*a* by laterally winding the metal hoop around the body 2*c* and through a welding means 21 to weld the abutting edges of the wound hoop 1*a* thereby to form a heat pipe blank 7*a* comprising an outer tube 1 and the wick-fixed inner tube housed therein. The heat pipe blank 7*a* so formed is then passed to the take-up roll 23, or, if desired, it is passed through, for example, a drawing die 22 to adjust the outer diameter and the compactness (or filling ratio) of the wick contained therein to a desired level thereby to form a modified heat pipe blank 7*b* which is then passed to the take-up reel 23.

The heat pipe blanks 7*a* and 7*b* so formed are cut into pieces of a desired length, charged with a volatile heat transfer liquid and then closed at both ends to obtain heat pipes.

EXAMPLE

Figure 6:
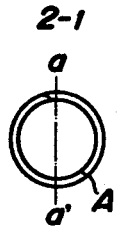
Figure 6A:
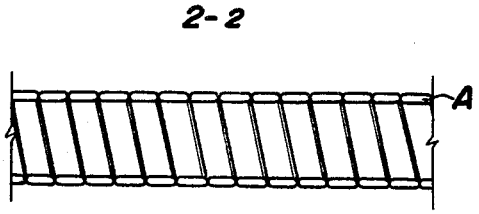
Figure 7:
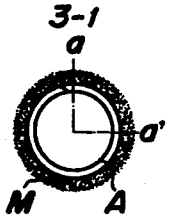
Figure 7A:
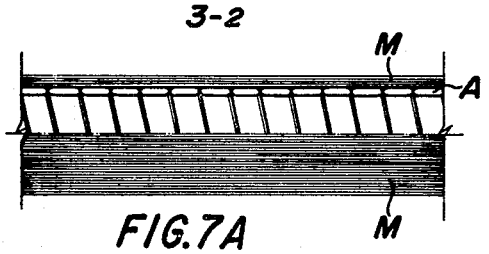
Figure 8:
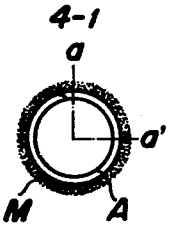
Figure 8A:
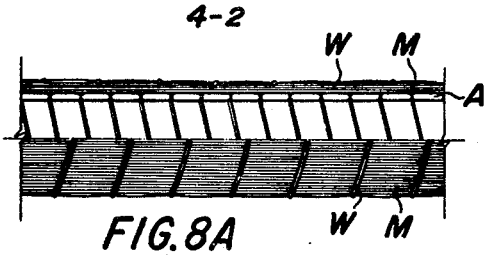

In this example the apparatus shown in FIG. 5 is used. From the supply spool 8 is supplied, as a material for the inner tube 2, a metal hoop 2*a* 0.4 mm thick and 1.2 mm wide which is close-spiralled (with substantially no or little space between the adjacent edges) as shown in FIG. 6, rough-spiralled (with an appreciable space between the adjacent edges) as shown in FIG. 12 or alternately close- and rough-spiralled as shown in FIGS. 11 and 13, each to form a spirally formed tube having inner and outer diameters of 2.0 mm and 2.8 mm, respectively. The close-spiralled hoop 2*a*, for example, is passed through the straightening means 9 to obtain a straightened tube 2*a* the cross-sectional view of which is indicated in FIG. 6. The straightened tube 2*a* is passed through 6 fixed reels 10 disposed radially with respect to the moving direction of the tube 2*a* and each wound with the metal fibers 3 (0.012 mm × 3600) in the tow form to lay the metal fiber tows 3 on the tube 2*a* and through the pressing rolls to press the tows to the tube 2*a* and form a uniform layer thereof around the tube 2*a* thereby obtaining a metal fiber layer-covered tube 2*b* the cross-section of which is shown in FIG. 7. The wick-covered tube 2*b* is further passed through a rotary winding means 15 where it is spirally wound with a yarn of metallic or other fibers or with metal wire 12 to secure the wick 3 to the tube 2*b*. The wick-secured tube 2*c* so obtained is further passed through an oxidizing atmosphere in the heating furnace (an electric muffle furnace in this case) 17 at 850° C to form a film of the oxide of the wick on the surface thereof. The oxide film-covered wick is indicated at 3*a* and its cross-section is shown in FIG. 8.

For comparison, there were prepared four types of wicks made of stainless steel [JIS (Japanese Industrial Standards): SUS 304] fibers each having a diameter of 0.012 mm, a first type not being heat treated, a second type subjected to 400° C × 10 min. (that is, heat treated at 400° C for 10 minutes), a third type subjected to 600° C × 5 min. and a fourth type subjected to 800° C × 2 min. These types of wicks were examined by the use of a scanning electron microscope to find their surface conditions. The results are shown in FIGS. 15 – 18 is from which the fourth type wick subjected 800° C × 2 min. is found to have the most roughest surface due to the formation of an oxide film thereon.

These types of wicks were then tested for their intensity of capillary action in the following way. Each of the wicks was fitted with pieces of litmus paper at intervals of 50 mm along the length thereof, inserted into a glass tube and then allowed to stand erect in an aqueous solution comprising pure water and a few drops of acetic acid to measure the time needed for the solution to rise every 50 mm by its capillary action. The results are shown in FIG. 19.

In some cases, the wick-secured tube 2*c* may be cut into pieces of a desired length which are each inserted, as the wick-secured inner tube, into a suitable outer tube to form a heat pipe blank 7*a* as shown in FIG. 9. If the heat pipe blank 7*a* has a free space G between the outer and inner tubes, it may be cold worked to reduce the blank 7*a* in outer diameter thereby eliminating the free space G and improving or adjusting the positional fixing and compactness of the wick in the heat pipe.

In other cases, the oxidized wick-secured tube 2*c* is further passed through the tube-forming means 20 (consisting of a plurality of tube-forming rolls) where the tube 2*c* is continuously covered or embraced with a copper hoop 1*a* is being wound around the tube 2*c*, the hoop 1.0 mm thick and 16.5 mm wide being supplied from a reel 19 and then formed to a tubular shape by the use of tube-forming rolls 20. The tubular copper hoop which is 6.24 mm in outer diameter and 4.24 mm in inner diameter, is still further passed through the welding means 21 to weld the abutting edges thereof to form a seamed outer tube thereby obtaining a heat pipe blank 7*a* comprising the outer and inner tubes with the wick and free space G present therebetween as shown in FIG. 9. In this case, the cross-sectional area I between the inner and outer tubes is approximately 7.9 $mm^2$ and the total cross-sectional area II of the wick 3*b* consisting of metal fibers 0.012 mm × 3600 × 6 is about 2.44 $mm^2$. The filling ratio (II/I × 100%) is as low as nearly 30% and the wick is not in close contact with the inner wall of the outer tube due to the presence of the free space G, whereby the resulting heat pipe will not be fully satisfactory in performance and efficiency. If, however, the heat pipe blank *7a* is cold worked by the use of a drawing die or the like, only the outer tube will be deformed so that the outer and inner diameters are reduced and the wick *3a* is suitably brought into close contact with the inner wall of the outer tube *1b* as shown in FIG. 10. In addition, the filling ratio of the wick *3a* may be adjusted as desired by controlling the degree of cold working. In this example, the heat pipe blank *7a* having the copper hoop-made outer tube was 6.24 mm in outer diameter. When this heat pipe blank *7a* was cold worked to reduce its outer diameter to 6.05 mm the filling ratio of the wick was about 50%; the reduction to 6.0 mm, 5.8 mm and 5.7 mm gave the filling ratios of about 60%, about 70% and about 80%, respectively. In each case, the inner pipe *2a* was not appreciated to change in shape. Even when the blank *7a* was reduced to 5.64 mm in the outer diameter of the outer tube corresponding to a filling ratio of 100% or reduced to less than 5.64% mm by cold working, the inner tube still retained the circular shape of its cross section since the inner tube was a spirally formed hoop and it could be elongated while somewhat decreasing its diameter in accordance with the elongation of the outer tube by the passage thereof through, for example, a drawing die. The aforesaid heat pipe blank *7a* or *7b* is cut into pieces of a suitable length, and the pieces are charged with a heat transfer liquid and then closed at both ends thereby to obtain heat pipes 7.

As is apparent from the foregoing, the heat pipes of this invention are advantageous as indicated below.

(1) Heat pipes wherein the outer and inner tubes respectively have diameters of any desired size, may be obtained in any desired length.

(2) The wick contained in the heat pipes, which is important in capillary action, can easily be adjusted in filling ratio to any desired extent by subjecting the outer tube of the heat pipe to cold working.

(3) The wick contained in the heat pipes is still in contact with the inner and outer tubes of the heat pipes even when the heat pipes are, and have been, worked to bend them, thereby allowing the heat pipes to keep their function satisfactory.

(4) The free space within the inner tube is maintained as such for the heat pipe, thereby permitting a satisfactory circulation of the vapor of the heat transfer liquid and preventing a local dry-out thereof.

(5) When the close-spiralled hoop is used as the inner tube, it can be elongated while increasing its pitch by severely cold-working the outer tube.

(6) The use of an alternately close- and rough-spiralled hoop as the inner tube gives a satisfactory heat pipe.

The reason for this is as follows. In the case of a heat pipe wherein the outer tube and the close-spiralled hoop as the inner tube are equal in length to each other as shown in FIG. 10, vapor of the heat transfer or working liquid evolved by heating in the evaporation region cannot flow into the inside of the close-spiralled hoop thereby hindering the heat transfer by the vapor. However, in the case of a heat pipe shown in FIG. 4 and containing as the inner tube an alternately close- and rough-spiralled hoop having a rough-spiralled portion at both ends thereof where the evaporation region X′ is at one end and the condensing region Y′ at the other end, vapor of the working fluid evolved at the evaporation regions X′ passes through the gaps of the rough-spiralled portion X′, the inside of the close-spiralled portion and the gaps of the rough-spiralled portion Y′, to the wick at the condensing portion where it is condensed to the liquid which is then returned through the wick to the evaporation region X′ thus completing a cycle, as indicated by arrows in FIG. 14. The cycle is repeated as required. Such heat pipes as the above are suitable for heat transfer at each end thereof. Furthermore, the heat pipes containing an entirely rough-spiralled hoop as the inner tube have a feature that vapor of the working fluid can pass even through the gaps of the middle portion of the inner tube to the wick for condensation to the liquid thereon and, thus, they are useful depending on their use. In the process for the manufacture of heat pipes of this invention as previously mentioned, it is necessary to wind the wick-covered inner tube with a yarn of metallic or other fibers or with metal wire thereby securing the wick to the inner tube only if the wick-secured inner tube is intended to be obtained; however, if the wick-covered inner tube is to be covered with a tube-shaped and edge-welded hoop as the outer tube, it is not always necessary that the wick-covered inner tube be wound with a yarn of metallic or other fibers or with metal wire. The term "other fibers" used herein include artificial and natural fibers which are combustible or soluble. If a yarn of such other fibers is used in securing the wick to the inner tube and the wick-secured inner tube is inserted in the outer tube to obtain a heat pipe blank, the heat pipe blank so obtained may be heated or subjected to a suitable chemical treatment to remove the yarn thereby releasing the wick, that is the metal fibers, from the restraint by the yarn and obtaining a very satisfactory capillary action by the released wick. In addition, if the spiral inner tube in the heat pipe is one which is made of stainless steel, when heated after being inserted in the outer tube it will spring back due to its unique strain-deformation and increase in diameter thereby to contact the wick more closely to the inner wall of the outer tube. A spiral inner tube made of band steel or hoop as compared with that made of round steel, has a smooth inner surface and therefore a low resistance to vapor flow therethrough, and it has an excellent rigidity thereby making it easy to insert a wick in between the outer and inner tubes.

This invention has been explained by reference to the example wherein tows or yarns of only metallic fibers are used as the wick, however, it is to be understood that other fibers such as glass fibers and carbon fibers may be used in this invention.

As will be seen from the above, the process of this invention will continuously produce satisfactory heat pipes which have an extremely small diameter, great length and high heat transfer efficiency.

The heat pipes, the process for the manufacture thereof and the apparatus for conducting the process are very useful in many industrial fields.

What is claimed is:

1. In a wick-secured inner tubular material for a heat pipe, the combination comprising an elongated metal tubular material, a wick of metal fibers in tow form disposed about said metal tubular material, an oxidized film on the surface of said metal fibers to provide a rough surface on said metal fibers to increase the wettability thereof, and a binding material disposed about said wick to secure the wick to said metal tubular material, said metal tubular material with the wick of metal fibers secured hereto by said binding material being adapted to be disposed within an elongated outer tubular means to form said heat pipe with the metal fibers of said wick holding a heat transfer liquid by capillary action.

2. In a wick-secured inner tubular material according to claim 1 wherein said binding material comprises a yarn of metal fibers.

3. In a wick-secured inner tubular material according to claim 1 wherein said binding material comprises a yarn of artificial fibers.

4. In a wick-secured inner tubbular material according to claim 1 wherein said binding material comprises a yarn of natural fibers.

5. In a wick-secured inner tubular material according to claim 1 wherein said binding material comprises a metal wire.

6. In a wick-secured inner tubular material for a heat pipe, the combination comprising an elongated metal tubular material, a wick of metal fibers in tow form disposed about said metal tubular material, and a binding material disposed about said wick to secure the wick to said metal tubular material, said metal tubular material with the wick of metal fibers secured hereto by said binding material being adapted to be disposed within an elongated outer tubular means to form said heat pipe with the metal fibers of said wick holding a heat transfer liquid by capillary action, said elongated metal tubular material comprising a spirally wound hoop element having at least some spirally disposed edges which are spaced from one another, and wherein said spirally wound hoop element has a variable pitch to provide at least some differently spaced spirally disposed edges.

* * * * *